US005355840A

United States Patent [19]

Violi

[11] Patent Number: 5,355,840

[45] Date of Patent: Oct. 18, 1994

[54] STEAM GENERATOR CONTROLLED BY PRESSURE SWITCH

[75] Inventor: Raymond Violi, Marlens, France

[73] Assignee: Societe Cooperative DeProduction Bourgeois, Faverges, France

[21] Appl. No.: 895,913

[22] Filed: Jun. 9, 1992

[30] Foreign Application Priority Data

Jun. 10, 1991 [FR] France ..... 91 07265

[51] Int. Cl.[5] ..... F22B 35/00

[52] U.S. Cl. ..... 122/13.2; 122/446; 122/447; 200/83 N; 200/83 W; 392/400

[58] Field of Search ..... 122/446, 447, 448.1, 122/13.2; 200/83 W, 83 N; 392/400

[56] References Cited

U.S. PATENT DOCUMENTS 2,270,608 1/1942 Sandberg ..... 200/83 W
2,718,218 9/1955 Gray ..... 122/448.1
4,336,825 6/1982 Pion .

FOREIGN PATENT DOCUMENTS 0323939 7/1989 European Pat. Off. .
662932 7/1938 Fed. Rep. of Germany .
130758 1/1928 Switzerland .
656203 6/1986 Switzerland .

OTHER PUBLICATIONS

T. C. Elliott, Level Monitoring, Sep. 1990, from Power, vol. 134, No. 9, pp. 41–58.

*Primary Examiner*—Albert W. Davis, Jr.
*Attorney, Agent, or Firm*—Ratner & Prestia

[57] ABSTRACT

The steam generator according to the invention consists of a main vessel 1 equipped with heating devices 12 controlled by control devices 13. The water level in the steam generator is kept at an average level 5 by control devices 13 which control a water inlet solenoid valve 10. Measurement of the average water level 5 is achieved by a pressure switch 20 that is exposed to the pressure inside a measuring vessel 18 that communicates with the main vessel 1 via a lower measuring opening 22. Balancing pipework 34 links the pressure switch 20 to the pressure of the steam produced in the steam generator. Pressure switch 20 generates measuring signals that are sent via conductors 17 to control devices 13 in order to actuate solenoid valve 10.

7 Claims, 5 Drawing Sheets

STEAM GENERATOR CONTROLLED BY PRESSURE SWITCH

BACKGROUND OF THE INVENTION

1. Field of the Invention

The present invention relates to steam generators intended primarily to supply natural steam or pressurized steam that is injected into a cooking chamber for foodstuffs.

2. Description of the Prior Art

Steam generators generally consist of a main vessel bounded by a watertight wall that contains water. The water inlet pipework includes a water inlet control solenoid valve in order to inject water into the vessel via at least one water inlet opening. Steam outlet pipework communicates with the upper part of the main vessel via at least one steam outlet opening. Heating devices that can be connected to an external energy source are provided in order to heat the water contained in the main vessel. Control devices control the heating devices and water inlet control solenoid valve in accordance with input signals generated by water level detectors in the main vessel.

In known steam generators, the water level is kept essentially constant in the main vessel. To achieve this, means of detecting the water level are fitted in order to measure the water level and generate control signals for the water inlet solenoid valve.

Various types of methods of detecting the water level are in common use:

according to document EP-A-O 323 939, the water level is detected by a resistive sensor situated in the main vessel which comes into contact with the upper water level;

according to a second embodiment, the heating devices consist of vertical hollow heating tubes that contain the water to be heated and the upper part is equipped with a temperature measuring sensor mounted on the external peripheral surface of the tube; a drop in the water level below the area occupied by the temperature measuring sensor causes a rise in the temperature of the corresponding tube wall, this temperature rise is detected by the temperature sensor and the temperature rise is interpreted as a drop in the water level below the permitted level;

the article entitled LEVEL MONITORING, by Thomas C. Eliott which appeared in POWER No. 9 in September 1990, page 41 ff. states how to measure the water level in a steam generator by means of a pressure gauge but without specifying the means used;

document DE-C-662 932 long ago described how to measure the water level in a tank by using a device with a diaphragm that is in contact with the water.

These water level measuring devices have proved satisfactory up to now, at least during the initial periods of use. However, these known methods have drawbacks which become apparent either at the start of operation or after a period of prolonged operation.

For instance, detecting the water level by a resistive sensor does not allow correct detection if there is a requirement to produce steam using demineralised water. The resistivity of demineralised water is too high to allow correct operation of a resistive sensor.

In addition, all known methods, regardless of whether they involve a resistive sensor or the detection of temperature or pressure, are particularly sensitive to the presence of deposits of boiler scale or calcareous fur which inevitably form after the steam generator has been used for a more or less prolonged period. Deposited boiler scale or fur on a resistive sensor significantly alters the electrical signals produced by the sensor. Similarly, deposited boiler scale or fur on the internal wall of a heating tube in the area occupied by the temperature sensor significantly alters the operation of said sensor because the film of boiler scale or fur acts as a thermal insulator. Deposited boiler scale on the diaphragm of a pressure gauge significantly alters the ability of the diaphragm to change shape and affects detection accuracy.

SUMMARY OF THE INVENTION

The problem to be solved by the present invention is to eliminate the drawbacks associated with the presence of deposited boiler scale or fur that occurs after a steam generator has operated for an extended period of time.

The invention also makes it possible to correctly detect the water level even in the presence of demineralised water.

To achieve this, the invention proposes the detection of the water level in the steam generator by using special means to detect the pressure produced by the head of water in the steam generator, with such means generally being arranged so as to prevent any deposition of boiler scale. One particular difficulty is the fact that the pressure detected depends on the pressure of the steam generated. The invention therefore proposes to provide a means of compensating the effects that the pressure of the generated steam might have on the measurement of the water level.

According to another objective of the invention, the means of detecting the water level are provided by very inexpensive components that make it possible to achieve a significant reduction in the cost of manufacturing a steam generator.

In order to achieve these objectives as well as others, the steam generator according to the invention includes special means of detecting the water level. These means comprise:

A measuring vessel, comprising a lower communicating opening, that is associated with a pressure switch that is exposed to the pressure inside the measuring vessel; the pressure switch generates input signals as a function of said pressure and sends them to the means of controlling the injection of water into the steam generator;

Measuring pipework having a first end connected to a measuring opening located in the lower part of the main vessel below the water level and a second end that is connected to said lower communicating opening in the measuring vessel; said lower communicating opening is also located below the level in the main vessel, there is always a volume of air in the measuring vessel between the water and the pressure switch and this air is trapped in the measuring vessel because the normal water level is higher than the lower communicating opening in the measuring vessel. This avoids any contact between the water and the pressure switch. In particular, it prevents the formation of deposited boiler scale or fur on the active components of the pressure switch such as the pressure measuring diaphragm.

In this way, detection is obtained by a pressure measurement, and this measurement is practically insensitive to whether or not the water is demineralised and the fact that deposits of boiler scale or fur may form in certain parts of the steam generator. The pressure that is measured is the pressure produced by the head of water in the steam generator above a reference level which is close to the pressure switch.

In addition, the trapped air ensures thermal insulation between the diaphragm of the pressure switch and the water which is at boiling point.

The pressure switch ideally consists of a diaphragm that is capable of elastic deformation and which is entirely located above the water level in the measuring vessel having its first face exposed to the air pressure inside the measuring vessel and its second face exposed to the pressure inside a balancing chamber. The diaphragm is connected to electrical conductors that form switches which close and open depending on the deformation of the diaphragm under the effects of the pressure difference between the measuring vessel and the balancing chamber.

In the case of a steam generator which must produce pressurized steam, the balancing chamber is ideally connected to the first opening of balancing pipework, the second opening of which is connected to an upper opening in the main vessel, said upper opening being located above the water level. The pressure in the balancing chamber is therefore the same as the pressure of the steam produced in the generator.

BRIEF DESCRIPTION OF THE DRAWINGS

Further objects, characteristics and advantages of the present invention will be apparent from the following description of particular embodiments, reference being made to the accompanying drawings in which.

DESCRIPTION OF THE PREFERRED EMBODIMENTS

Figure 1:
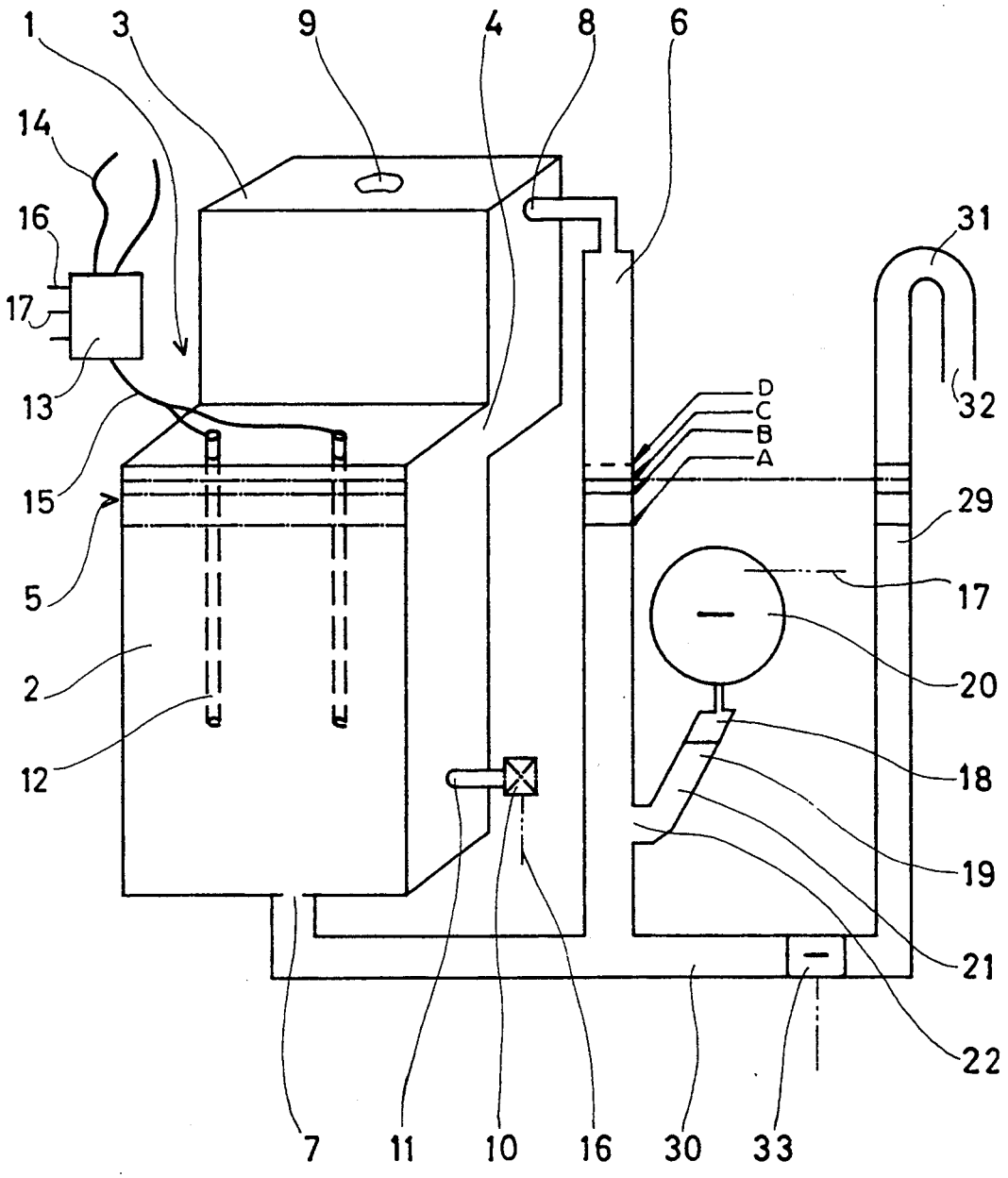
FIG. 1 is a schematic representation of the overall structure of a steam generator according to the present invention in an embodiment to produce natural steam.

As shown in the figures, a steam generator according to the present invention includes a main vessel 1 that is bounded by a watertight wall to contain water.

In the embodiments shown, main vessel 1 consists of a lower compartment 2 and an upper compartment 3. Lower compartment 2 and upper via a compartment 3 are connected to each other baffle 4 or transverse part so that the lower compartment 2 and the upper compartment 3 are laterally offset in relation to each other. The steam generator is intended to contain water up to an average level 5 situated preferably below baffle 4 in the upper part of lower compartment 2. Upper compartment 3 is intended to contain steam and exclude water in the liquid phase.

In the embodiment shown, lower compartment 2 and upper compartment 3 form a main chamber which is itself connected to a secondary chamber 6 that is connected in parallel to the main chamber. Secondary chamber 6 is connected in parallel between lower communicating opening 7 situated below the average water level 5 and upper communicating opening 8 situated above the average water level 5. Secondary chamber 6 is an area where the water level is stable in contrast to the water level in the main chamber which is exposed to the effects of turbulent convection in the water during the production of steam.

Main vessel 1, preferably in upper compartment 3, is fitted with a steam outlet opening 9 that is connected to steam outlet pipework (not represented). Steam outlet opening 9 is situated in the upper part of the main vessel.

Water inlet pipework that includes water inlet control solenoid valve 10 is used to inject water into vessel 1 via at least one water inlet opening 11.

Heating devices 12, shown diagrammatically in the Figures in the form of two immersion heating elements, are provided in order to heat the water contained in the main vessel. The heating devices can be connected to an external energy source. Heating devices 12 are preferably positioned to heat the water in lower compartment 2 in main vessel 1.

Control devices 13 are used to control the various functional units of the steam generator. In particular, control devices 13 are used to switch on or switch off the transmission of electric energy from electricity supply line 14 to heating devices 12 to which they are connected by conductors 15. Heating devices 13 are also used to switch on or switch off the supply of electric power to solenoid valve 10 to which they are connected by a pair of conductors 16. Heating devices 13 respond depending on the input signals that are present on input conductors 17.

The steam generator according to the invention includes measuring vessel 18 which has a lower communicating opening 19 and a pressure switch 20. Pressure switch 20 is exposed to the pressure inside measuring vessel 18 and generates input signals on input conductors 17 that transmit the signals to control devices 13.

Measuring pipework 21 has its first end connected to a measuring opening 22 situated in the lower part of main vessel 1 below average water level 5 and its second end is connected to said lower communicating opening 19 in measuring vessel 18. Said lower communicating opening 19 is also located below average water level 5 in main vessel 1. Measuring opening 22 can ideally be situated in the lower part of secondary chamber 6 of main vessel 1.

As shown in the figures, the water level in measuring pipework 21 and measuring vessel 18 is located essentially at the level of lower communicating opening 19 in the measuring vessel and pressure switch 20 is situated in the upper part of the measuring vessel, i.e. above lower communicating opening 19. Air can therefore be introduced into the measuring chamber and remains trapped in the chamber and cannot escape via communicating opening 19 which is sealed by water. In this way, there is always a volume of air in measuring vessel 18 between the water and pressure switch 20.

Figure 4:
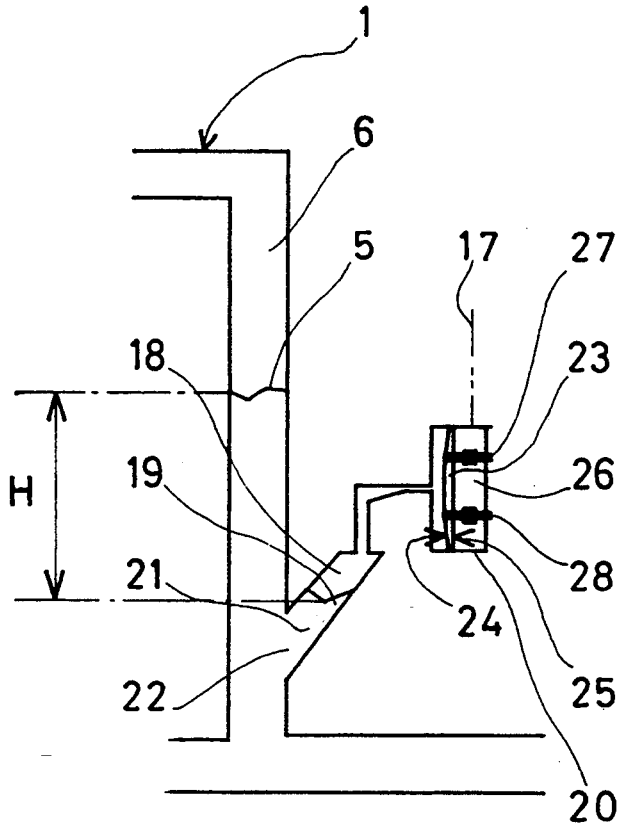
FIG. 4 illustrates an embodiment detail of the pressure switch used in the embodiment in FIG. 1.

The structure of the means of measuring the water level in the embodiment in FIG. 1 is shown on an enlarged scale in FIG. 4. In this embodiment, pressure switch 20 consists of a diaphragm 23 that is capable of elastic deformation having its first face 24 exposed to the air contained in the measuring vessel and therefore to the pressure inside measuring vessel 18 and its second face 25 exposed to the pressure inside balancing chamber 26. Diaphragm 23 is connected to electrical conductors, such as conductors 27 and 28, that form switches which close and open depending on the deformation of diaphragm 23 under the effects of the pressure difference between measuring vessel 18 and balancing chamber 26.

In the embodiment in FIGS. 1 and 4 in which the steam generator is intended to produce natural steam that escapes via outlet opening 9, balancing chamber 26 may either be a watertight chamber containing a constant quantity of air capable of compressing or expanding depending on the movement of diaphragm 23 or, ideally, a chamber that is vented to atmospheric pressure by a duct (not represented). The pressure inside measuring vessel 18 equals the steam pressure above average water level 5 in main vessel 1 plus the pressure of the head of water H situated between average water level 5 and the water level in lower communicating opening 19 in the measuring vessel. It is clear that a change in average water level 5 causes a change in pressure due to head of water H, and that this produces a movement of diaphragm 23 and electrical conductors 27 and 28, thus producing electrical signals that are sent to control devices 13 via input conductors 17.

In the embodiment shown, the steam generator according to the invention also has means of draining. This means of draining consists of drain pipework 29 connected to lower drain opening 30 in main vessel 1 with a water seal 31 that leads to outlet opening 32. Pump 33 is fitted in drain pipework 29 and discharges into water seal 31. Water seal 31 is located at a higher level than average water level 5 in the steam generator.

Figure 2:
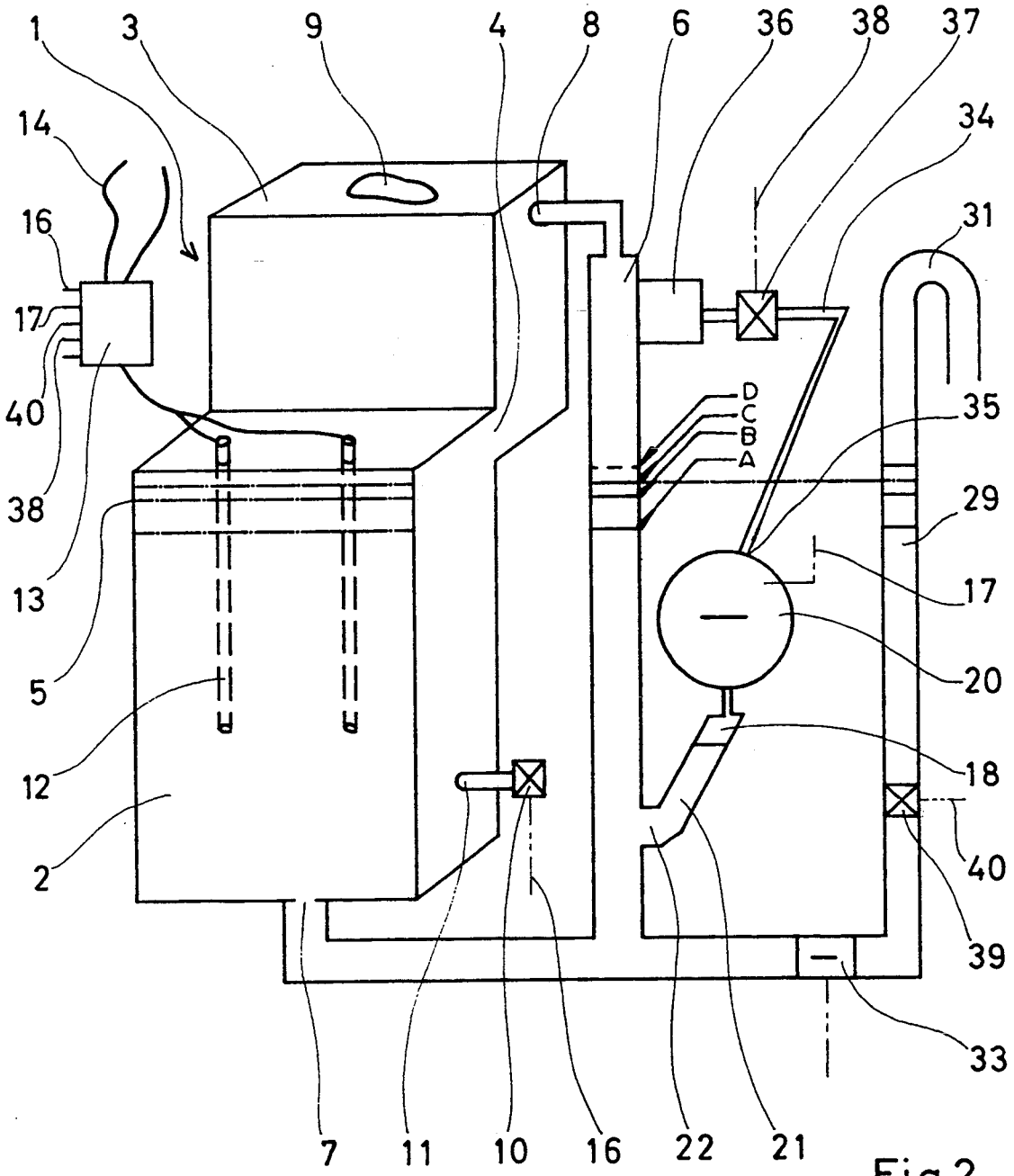
FIG. 2 represents the overall structure of a steam generator according to the invention in an embodiment intended to produce pressurized steam.
Figure 5:
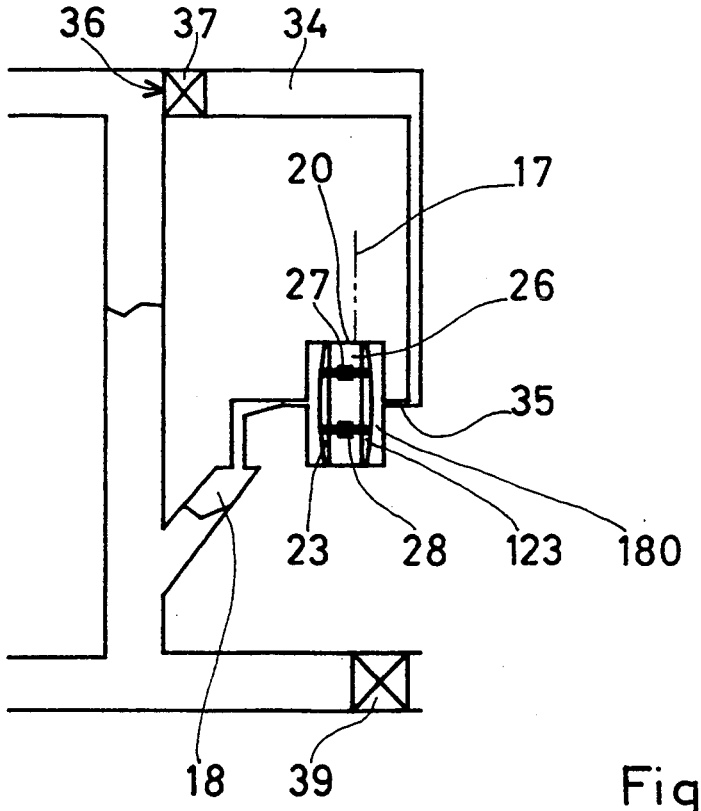
FIG. 5 illustrates a possible pressure switch embodiment used in the embodiment in FIG. 2.

The embodiment in FIGS. 2 and 5 makes it possible to produce pressurized steam that escapes via steam outlet opening 9. The steam generator according to this embodiment has the same functional units as those in the embodiment in FIGS. 1 and 4. These functional units are identified by the same numerical references and include, in particular: main vessel 1 with its lower compartment 2 and upper compartment 3, secondary chamber 6 connected in parallel between lower communicating opening 7 and upper communicating opening 8, steam outlet opening 9, solenoid valve 10 to control the inlet of water via water inlet opening 11, control devices 13, measuring vessel 18 with pressure switch 20 and drain pipework 29.

Compared with the previous embodiment in FIGS. 1 and 4, this embodiment in FIGS. 2 and 5 also contains balancing pipework 34 equipped with a first opening 35 and a second opening 36. First opening 35 is connected to a second measuring vessel 180 of pressure switch 20. Second opening 36 is connected to an upper opening in main vessel 1 in a position so that second opening 36 is situated above average water level 5. Solenoid valve 37 may be fitted in balancing pipework 34 and is controlled by control devices 13 to which it is linked by control conductors 38.

In the embodiment in FIG. 5, pressure switch 20 consists of two diaphragms capable of elastic deformation, namely first diaphragm 23 which is similar to that in the embodiment in FIG. 4 and second diaphragm 123 which is parallel to first diaphragm 23. Electrical conductors 27 and 28 form switches and constitute mobile spacers that move with either of diaphragms 23 and 123 and open and close electrical contacts depending on the deformation of the diaphragms under the effect of the pressure difference between measuring vessel 18 and second measuring vessel 180. Electrical conductors 27 and 28 are therefore isolated from the atmosphere inside measuring vessel 18 and in second measuring vessel 180. Balancing chamber 26 may ideally be at atmospheric pressure.

In the embodiment in FIGS. 2 and 5, the steam generator must also have a drain solenoid valve 39 fitted in drain pipework 29 in order to allow or stop the flow of water in drain pipework 29. Solenoid valve 39 prevents the production of steam pressure from causing the removal of water via water seal 31 if the steam pressure exceeds the weight of the head of water between average water level 5 and water seal 31. Solenoid valve 39 is controlled by control devices 13 to which it is linked by control conductors 40.

Figure 3:
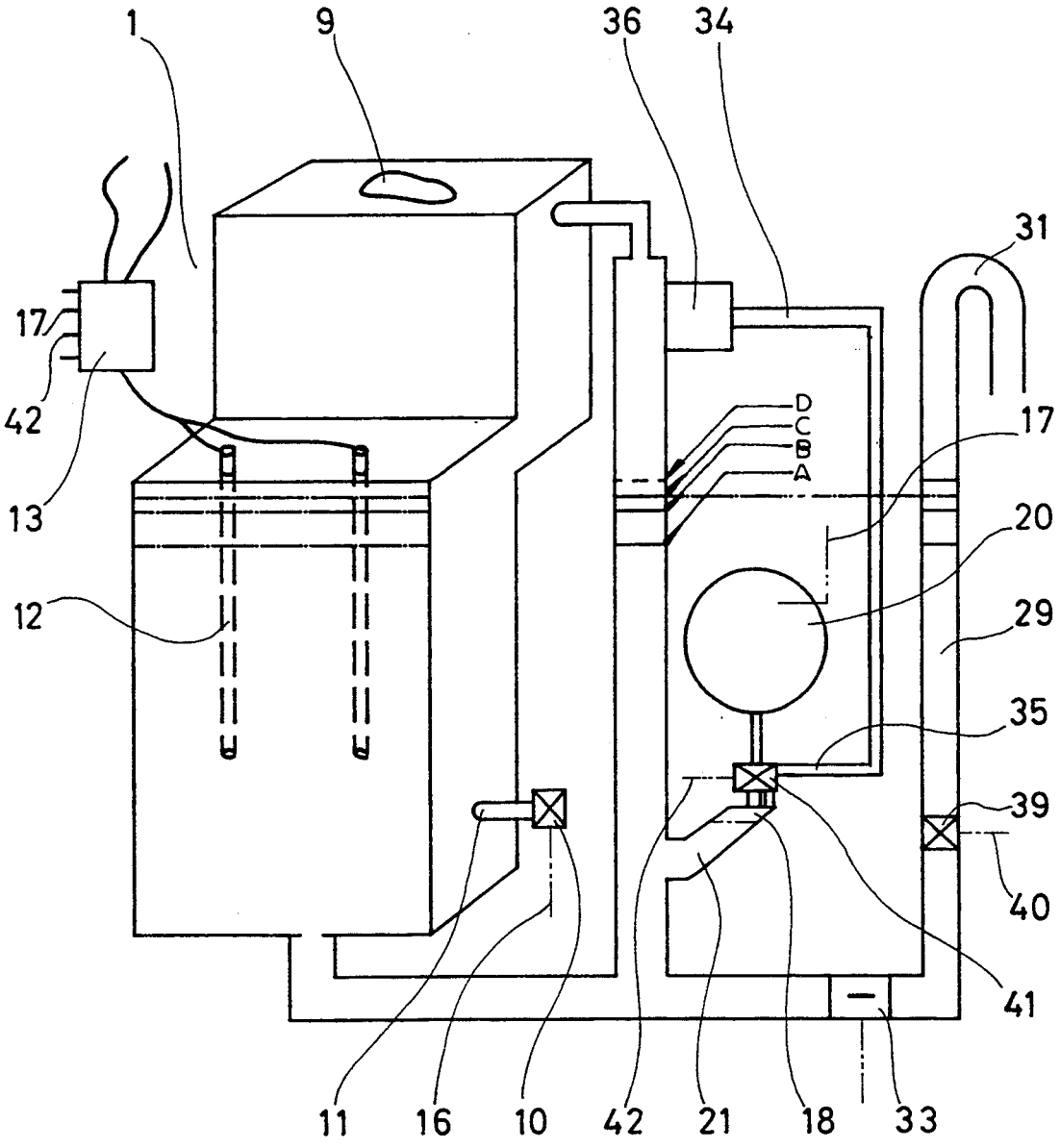
FIG. 3 illustrates another embodiment intended to produce pressurized steam.

FIG. 3 shows an alternative embodiment of a steam generator according to the present invention to produce pressurized steam. In this embodiment, the steam generator has the same functional units as those described in connection with FIG. 1 with main vessel 1, heating devices 12, control devices 13, measuring vessel 18, pressure switch 20 which generates input signals that are sent to the control devices via input conductors 17, pump 33 fitted in drain pipework 29 equipped with a water seal 31. In this embodiment in FIG. 3, drain pipework 29 also includes drain solenoid valve 39 which is controlled by conductors 40 that link it to control devices 13. Also, balancing pipework 34 is connected via second opening 36 to the upper part of main vessel 1 in the same way as in the embodiment in FIG. 2. However, in the embodiment in FIG. 3, first opening 35 of drain pipework 34 is not connected to second measuring vessel 180 of pressure switch 20, but to one of the inputs of 3-way solenoid valve 41 that is controlled by control devices 13 via conductors 42. 3-way solenoid valve 41 is fitted between pressure switch 20 and measuring vessel 18 as shown in the Figure and makes it possible to connect pressure switch 20 alternately to the pressure inside measuring vessel 18 or the pressure of the steam produced by the steam generator and carried by balancing pipework 34.

In all the embodiments, pressure switch 20 ideally generates input signals comprising at least four different signals which correspond respectively to four different pressure levels in measuring vessel 18. In the Figures, these four pressure levels are denoted by the letters A, B, C and D.

Control devices 13 are suitable to:

order the opening of water inlet solenoid valve 10 in the presence of an input signal corresponding to a pressure lower than that produced by the height of the head of water H if the water level equals lower level A; the solenoid valve can be closed again as soon as level A is reached unless an additional command signal to open the valve is generated by other devices stated below:

enable the switching on of heating devices 12 in the presence of an input signal corresponding to a pressure higher than that produced by head of water H if the water level equals intermediate level B and to prevent operation of heating devices 12 if the input signal indicates a lower pressure;

order the switching on of heating devices 12 and the closing of water inlet solenoid valve 10 in the presence of an input signal corresponding to a pressure higher than that produced by head of water H if the water level is at upper intermediate level C and switch off the heating devices 12 and open water inlet solenoid valve 10 if the input signal indicates a lower pressure;

order the closing of water inlet solenoid valve 10 in the presence of an input signal corresponding to a pressure higher than that produced by the head of water if the water level is at upper level D.

During normal operation, average water level 5 in the steam generator is close to level C. Control devices 13 ensure that electric power is supplied to heating devices 12. The water level tends to drop due to vaporisation and, when it drops below level C, control devices 13 open solenoid valve 10 and inject water into the steam generator. The level then rises above average level C and control devices 13 close solenoid valve 10. If solenoid valve 10 is not switched off, the water level reaches level D and this causes the sending of an overflow safety signal and the closing of solenoid valve 10.

If, when average water level 5 drops, the opening of solenoid valve 10 is not ordered by the usual means of regulating the water level around level C, the surface of the water reaches level B which is detected by pressure switch 20. The signal produced by the pressure switch then, via control devices 13, switches off the power supply to heating devices 12. In the event of a subsequent drop in the water level as far as level A, control devices 13 then open solenoid valve 10 in order to inject water.

In addition, in the embodiment in FIGS. 2 and 3, solenoid valve 39 is closed during all the stages when there is a requirement to produce pressurized steam and solenoid valve 29 is only open during drain cycles.

In the embodiment in FIG. 2, solenoid valve 37 may be closed during operating cycles in order to produce natural steam and must be opened during operating cycles to produce pressurized steam.

Figure 6:
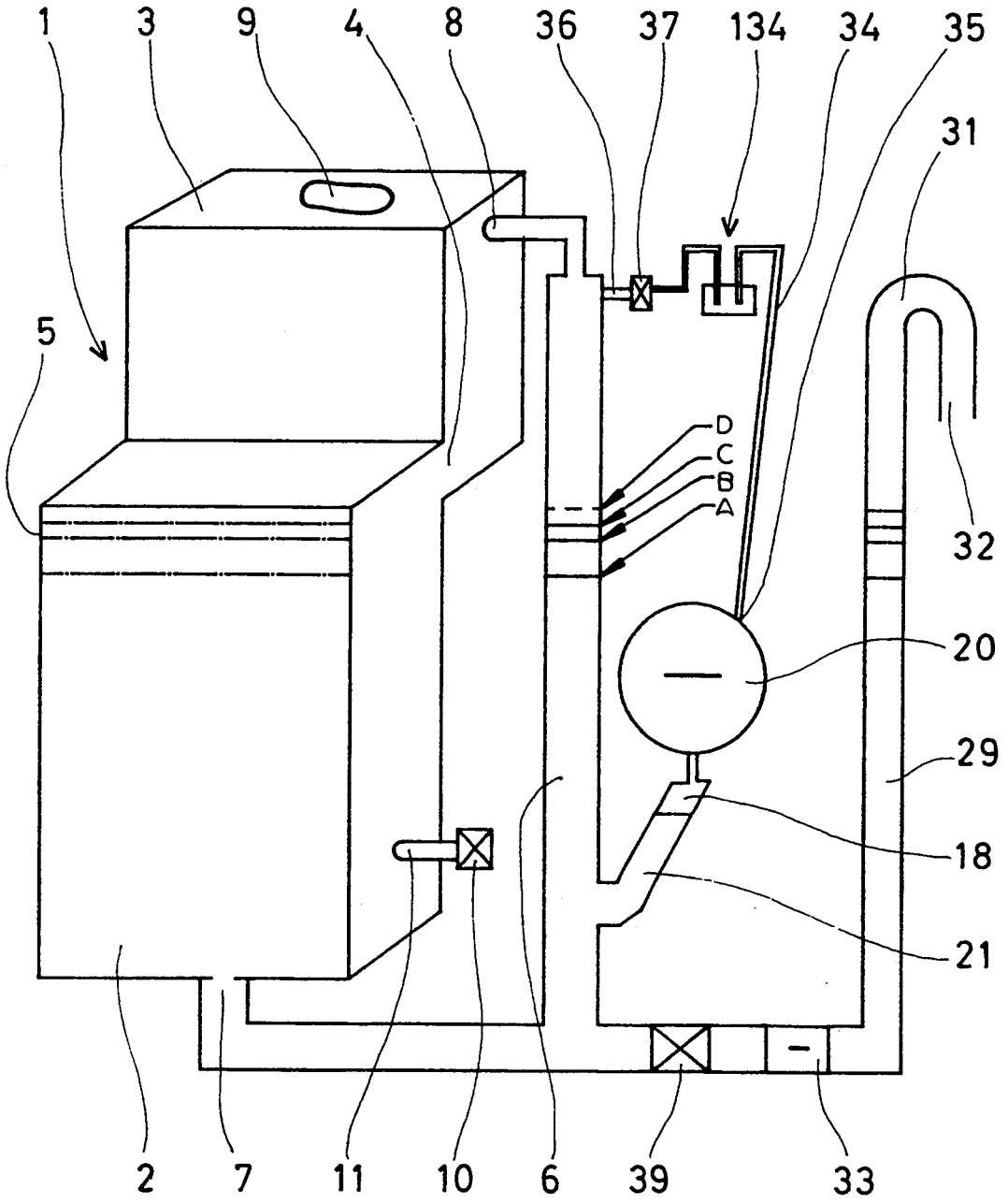
FIG. 6 illustrates an alternative embodiment to FIG. 2.

FIG. 6 shows an alternative embodiment to FIG. 2. This alternative uses the same functional components identified by the same numeric references. In addition, a separator 134 is fitted in balancing pipework 34. Separator 134 has the task of transmitting the pressure throughout the balancing pipework and preventing steam from main vessel 1 from reaching pressure switch 20. The diaphragm of pressure switch 20 is therefore exposed to the balancing pressure without coming into contact with hot, aggressive steam.

In the embodiment in FIG. 3, 3-way solenoid valve 41 can have two operating modes: to produce natural steam, solenoid valve 41 can continuously connect pressure switch 20 and measuring vessel 18; to produce pressurized steam, solenoid valve 41 alternately connects pressure switch 20 to measuring vessel 18 or balancing pipework 34.

The present invention is not confined to the embodiments explicitly described and includes the various alternatives within the scope of the invention as defined in the appended claims.

I claim:

1. Steam generator comprising:

a main vessel bounded by a watertight wall to contain water, water inlet pipework including a water inlet control solenoid valve to inject water into the vessel via at least one water inlet opening, steam outlet pipework that communicates with the upper part of the main vessel via at least one steam outlet opening, heating devices connected to an external energy source and positioned to heat the water contained in the main vessel, a measuring vessel comprising a lower communicating opening having a water level situated below the average water level in the main vessel and associated with a pressure switch exposed to the pressure inside the measuring vessel, wherein the pressure switch generates input signals, comprising at least four different signals on input conductors which signals correspond respectively to four different pressure levels in the measuring vessel, wherein the pressure inside the measuring vessel substantially equals the steam pressure in the main vessel plus a pressure head of water situated between the average water level in the main vessel and the water level in the lower communicating opening in the measuring vessel, measuring pipework having a first end connected to a measuring opening located in the lower part of the main vessel below the average water level and a second end connected to said lower communicating opening in the measuring vessel, a volume of air in the measuring vessel continuously trapped between the water and pressure switch, control means, responsive to said input signals and connected to said input conductors, for controlling the heating devices and the solenoid valve to control water inlet as a function of said input signals, so that, during normal operation, the control means ensures that power is supplied to the heating devices and when the water level in the main vessel drops below a predetermined level, the control means opens said solenoid valve, causing water to be injected into the steam generator.

2. Water generator as claimed in claim 1, wherein the pressure switch has at least one diaphragm capable of elastic deformation having its first face exposed to the pressure inside the measuring vessel and its second face exposed to the pressure inside a balancing chamber, said diaphragm is connected to electrical conductors that form switches which close and open depending on the deformation of the diaphragm under the effects of the pressure difference between the measuring vessel and the balancing chamber.

3. Steam generator as claimed in claim 2, wherein a second measuring vessel is connected to a first opening of balancing pipework whose second opening is connected to an upper opening in the main vessel, said second opening being situated above the average water level in the main vessel.

4. Steam generator as claimed in claim 2, wherein a 3-way valve is fitted between the measuring vessel and the pressure switch in order to selectively connect the pressure switch either to the atmosphere inside said measuring vessel or to a first opening of balancing pipework whose second opening is connected to an upper opening in the main vessel, said second opening being situated above the average water level and said 3-way valve being controlled by said control means.

5. Steam generator as claimed in claim 1, wherein the control devices are suitable to:

order the opening of the water inlet control solenoid valve in the presence of an input signal corresponding to a pressure lower than that produced by the height of water if the water level equals a lower level with the valve being closed again as soon as the level is reached, unless an additional opening command signal is generated by other devices stated below:

enable the switching on of the heating devices in the presence of an input signal corresponding to a pressure higher than that produced by the height of water if the water level equals an intermediate level and prevent operation of the heating devices if the input signal indicates a lower pressure;

order the switching on of the heating devices and the closing of the water inlet solenoid valve in the presence of an input signal corresponding to a pressure higher than that produced by the height of water if the water level is at an upper intermediate level and switch off the heating devices and open the water inlet solenoid valve if the input signal indicates a lower pressure;

order the closing of the water inlet control solenoid valve in the presence of an input signal corresponding to a pressure higher than that produced by the height of water if the water level is at the upper level.

6. Steam generator as claimed in claim 1, also having means of draining consisting of drain pipework connected to a lower drain opening in the main vessel and equipped with a pump that discharges into a water seal and is associated with a solenoid valve.

7. Steam generator comprising:

a main vessel bounded by a watertight wall to contain water and defining:

(a) a main chamber having a steam outlet opening, and (b) a secondary chamber connected in parallel with said main chamber between a main vessel lower communicating opening situated below the average water level and a main vessel upper communicating opening situated above the average water level, water inlet pipework including a water inlet control solenoid valve to inject water into the vessel via at least one water inlet opening, steam outlet pipework that communicates with the upper part of the main vessel via said steam outlet opening, heating devices connected to an external energy source and positioned in the main chamber to heat the water contained in the main vessel, a measuring vessel comprising a measuring vessel lower communicating opening having a water level situated below the average water level in the main vessel and associated with a pressure switch exposed to the pressure inside the measuring vessel, wherein the pressure switch generates input signals on input conductors, wherein the pressure inside the measuring vessel substantially equals the steam pressure in the main vessel plus a pressure head of water situated between the average water level in the main vessel and the water level in the measuring vessel lower communicating opening, measuring pipework having a first end connected to a measuring opening located in the lower part of the secondary chamber below the average water level and a second end connected to said lower in the measuring vessel communicating opening, a volume of air in the measuring vessel continuously trapped between the water and pressure switch, control means, responsive to said input signals and connected to said input conductors, for controlling the heating devices and the solenoid valve to control water inlet as a function of said input signals, so that, during normal operation, the control means ensures that power is supplied to the heating devices and when the water level in the main vessel drops below a predetermined level, the control means opens said solenoid valve, causing water to be injected into the steam generator.

* * * * *

UNITED STATES PATENT AND TRADEMARK OFFICE

CERTIFICATE OF CORRECTION

PATENT NO. : 5,355,840

DATED : Oct. 18, 1994

INVENTOR(S) : Violi

It is certified that error appears in the above-identified patent and that said Letters Patent is hereby corrected as shown below:

Column 3, line 6, should read:

measured is the pressure produced by the height of water

Column 3, lines 60-63 should read:

Lower compartment 2 and upper compartment 3 are connected to each other via a baffle 4 or transverse part so that the lower compartment 2 and the upper compartment 3 are laterally offset

UNITED STATES PATENT AND TRADEMARK OFFICE

CERTIFICATE OF CORRECTION

PATENT NO. : 5,355,840

DATED : Oct. 18, 1994

INVENTOR(S) : Violi

It is certified that error appears in the above-indentified patent and that said Letters Patent is hereby corrected as shown below:

Column 4, line 32-35, should read:

connected by conductors 15. Control devices 13 are also used to switch on or switch off the supply of electric power to solenoid valve 10 to which they are connected by a pair of conductors 16. Control devices 13

Signed and Sealed this

Twenty-fifth Day of April, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,355,840
DATED : October 18, 1994
INVENTOR(S) : Violi

It is certified that error appears in the above-indentified patent and that said Letters Patent is hereby corrected as shown below:

Title page, item [73], Assignee: should read--Societe Cooperative De Production, Bourgeois, Faverges, France--.

Signed and Sealed this

First Day of August, 1995

*Attest:*

*Attesting Officer*

BRUCE LEHMAN

*Commissioner of Patents and Trademarks*